US006000700A

United States Patent [19]

Nesler et al.

[11] Patent Number: 6,000,700

[45] Date of Patent: Dec. 14, 1999

[54] GRANULATE-BACKSTOP ASSEMBLY

[75] Inventors: Leslie F. Nesler, St. Paul; Paul T. Faust, Edina, both of Minn.

[73] Assignee: Caswell International Corporation, Minneapolis, Minn.

[21] Appl. No.: 09/295,016

[22] Filed: Apr. 20, 1999

Related U.S. Application Data

[63] Continuation of application No. 09/006,454, Jan. 13, 1998, Pat. No. 5,901,960.

[51] Int. Cl.[6] ..... F41J 1/12

[52] U.S. Cl. ..... 273/410

[58] Field of Search ..... 273/410

[56] References Cited

U.S. PATENT DOCUMENTS

| | | |
|---|---|---|
| D. 329,680 | 9/1992 | Burn . |
| 941,642 | 11/1909 | Maxim . |
| 4,294,452 | 10/1981 | Schlotter et al. . |
| 4,728,109 | 3/1988 | Simonetti . |
| 4,787,289 | 11/1988 | Duer . |
| 4,819,946 | 4/1989 | Kahler . |
| 4,846,043 | 7/1989 | Langsam . |
| 4,919,437 | 4/1990 | Salabe et al. . |
| 5,070,763 | 12/1991 | Coburn . |
| 5,113,700 | 5/1992 | Coburn . |
| 5,121,671 | 6/1992 | Coburn . |
| 5,171,020 | 12/1992 | Wojcinski . |
| 5,255,924 | 10/1993 | Copius . |
| 5,340,117 | 8/1994 | Wojcinski . |
| 5,435,571 | 7/1995 | Wojcinski et al. . |
| 5,607,163 | 3/1997 | Nesler . |
| 5,848,794 | 12/1998 | Wojcinski et al. . |
| 5,901,960 | 5/1999 | Nester et al. ..... 273/410 |

FOREIGN PATENT DOCUMENTS

| | | |
|---|---|---|
| 0 227 612 | 7/1987 | European Pat. Off. . |
| 0 399 960 | 11/1990 | European Pat. Off. . |
| 3131228 | 3/1983 | Germany . |
| 3212781 | 10/1983 | Germany . |

*Primary Examiner*—William H. Grieb
*Attorney, Agent, or Firm*—Merchant & Gould P.C.

[57] ABSTRACT

A projectile trap assembly for capturing projectiles emitted along a line substantially parallel to a ground surface includes a support frame generally inclined relative to the line of the projectiles; a primary volume of particulate material disposed on the support frame for slowing down and capturing the projectiles, the primary volume including a target region in which a majority of the projectiles are captured; and the support frame having a trap door positioned proximate the target region, the trap door being arranged and configured to allow a portion of the primary volume of particulate material coinciding generally with the target region to be removed from the trap assembly through the support frame.

5 Claims, 3 Drawing Sheets

GRANULATE-BACKSTOP ASSEMBLY

This application is a Continuation of application Ser. No. 09/006,454, filed Jan. 13, 1998, now U.S. Pat. No. 5,901,960 which applications are incorporated herein by reference.

Field of the Invention

The invention is directed to a trap assembly, and more particularly to a projectile trap or backstop assembly for capturing projectiles.

BACKGROUND OF THE INVENTION

Projectile trap assemblies or backstop assemblies have been known whose object is to slow down and capture projectiles fired into them from a specified distance. The following U.S. patents have disclosed examples of different types of projectile trap assemblies or backstop assemblies: U.S. Pat. No. 5,171,020 issued to Wojcinski; U.S. Pat. No. 5,340,117 issued to Wojcinski; U.S. Pat. No. 5,435,571 issued to Wojcinski et al.; U.S. Pat. No. 5,607,163 issued to Nesler. In these patents, various target backstop assemblies using particulate granulated material are disclosed. The granulate material traps the projectiles. After a period of time of use, the granulate material may be saturated so that the granulate material and the entrapped projectiles or projectile fragments are transferred to be recovered and reconditioned thereafter. The reconditioned granulated material is re-used in the assembly. These types of assemblies may be used for a period of time depending on their trapping capacity. The longer, wider, and thicker the granulated material of the trap assembly is, the larger the capacity of the assembly has, and the less frequent the trap assembly needs to be transferred and recycled. However, the size of the trap assembly does not ultimately determine the trapping capacity. Most of the projectiles are generally trapped in a certain region of the granulated material, which need to be removed and recycled frequently, whereas the projectiles trapped in the other regions of the granulated material do not.

Therefore, a substantial need exists for a trap assembly which is capable of recovering and recycling a designated region of the granulated material of the trap assembly so as to prolong the use of the trap assembly before the entire trap assembly needs to be recycled.

SUMMARY OF THE INVENTION

The invention is directed to a trap assembly. More particularly, the invention is directed to a projectile backstop assembly for capturing projectiles inclined relative to a line of the projectiles.

In one embodiment generally in accordance with the principles of the present invention, a projectile trap assembly for capturing projectiles emitted along a line substantially parallel to a ground surface, the trap assembly comprises:

a support frame generally inclined relative to the line of the projectiles;

a primary volume of particulate material disposed on the support frame for slowing down and capturing the projectiles, the primary volume including a target region in which a majority of the projectiles are captured; and the support frame having a trap door positioned proximate the target region, the trap door being arranged and configured to allow a portion of the primary volume of particulate material coinciding generally with the target region to be removed from the trap assembly through the support frame.

Still in one embodiment of the present invention, the trap door is generally parallel to the line of the projectiles.

Further in one embodiment of the invention, the support frame has a first step portion, the first step portion has a first surface generally parallel to the line of the projectiles, and the trap door is disposed on the first surface of the first step portion. In one embodiment, the trap door is a slidable door.

Yet in one embodiment, the support frame has a second step portion positioned above the first step portion. The first step portion has a second surface generally vertical to the ground, and a third surface between the first and the second surfaces, wherein the third surface is inclined relative to the line of the projectiles. In one embodiment, the third surface is aligned at an angle of repose of the particulate material.

According to one aspect of the invention, there is provided a trap assembly as recited above wherein when the trap door is opened, the portion of the primary volume of particulate material within the target region flows by gravity through the corresponding opening. In one embodiment of the invention, the primary volume of particulate material includes a reserve portion located above the target region, wherein when the trap door is opened the reserve portion flows into the target region to maintain constant a depth of material at the target region.

Still according to one aspect of the invention, there is provided a trap assembly as recited above and further comprising a separate supplemental volume of particulate material portion located behind the reserve portion of the primary volume of particulate material, the supplemental volume being arranged and configured for providing a backup for slowing down and receiving the projectiles when the reserve portion flows into the target region. In one embodiment, the primary and supplemental volumes of particulate material are separated by a self-healing barrier.

Further in one embodiment of the invention, the support frame includes a first step positioned below a second step, each of the steps including a first surface adapted to be generally parallel to the line of the projectiles, a second surface generally perpendicularly aligned with respect to the first surface, and a third surface extending between the first and second surfaces, the third surface being inclined relative to the line of the projectiles. Yet in one embodiment, the trap door is located at the first surface of the first step.

One advantage of the present invention is that it provides a trap assembly with means for easily, frequently recycling a majority of captured projectiles in a region without recycling the entire assembly so as to prolong the usage of the trap assembly. Another advantage of the invention is that it provides the trap assembly with extra backstop means when a volume of particulate material flows down to a target region to supply a removed volume.

These and other advantages and features, which characterize the invention are pointed out with particularity in the claims annexed hereto and forming a part hereof. However, for a better understanding of the invention and the advantages and objectives obtained by its use, reference should be made to the drawing which forms a further part hereof and to the accompanying descriptive matter, in which there is described a preferred embodiment of the invention.

DETAILED DESCRIPTION OF THE PREFERRED EMBODIMENT

Figure 1:
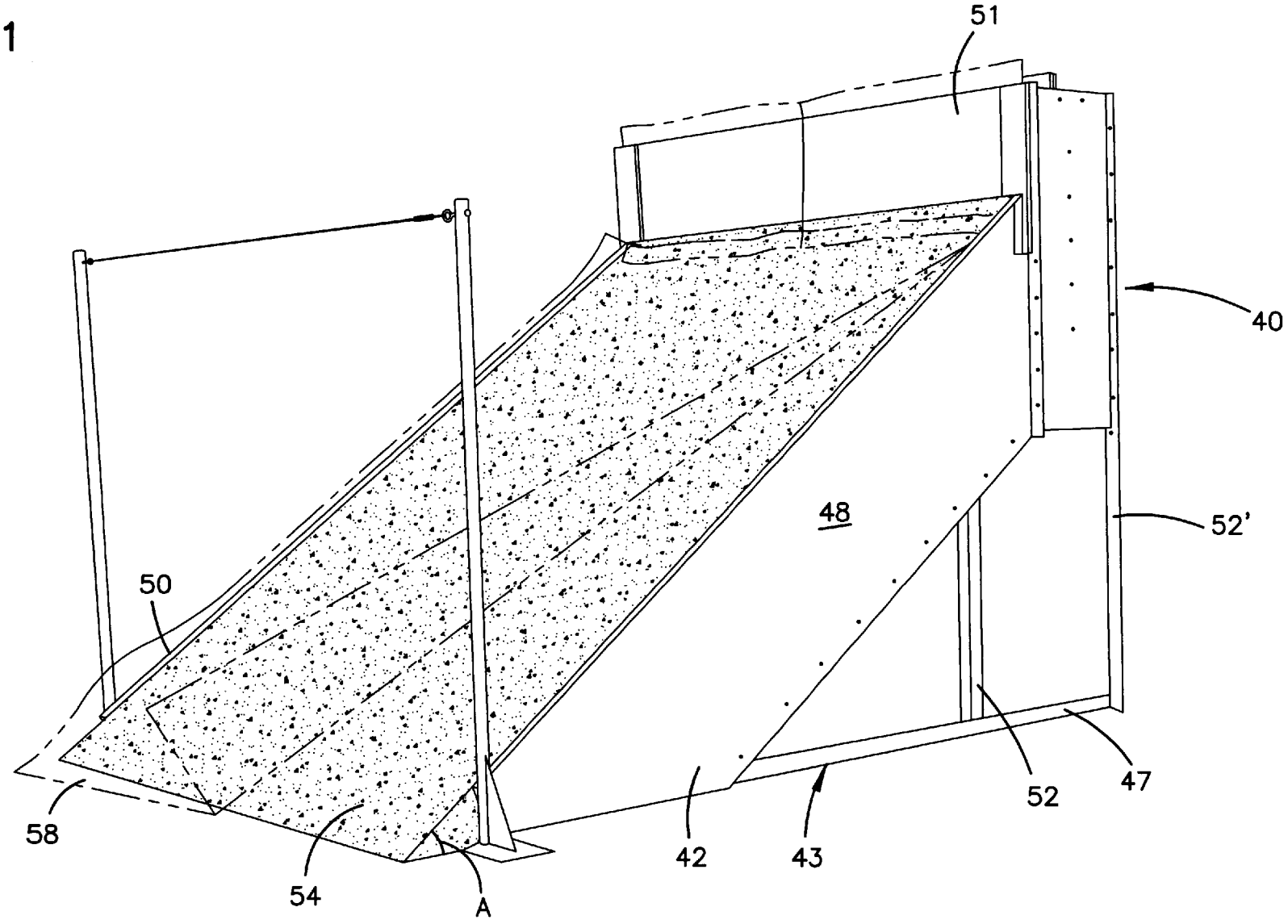
FIG. 1 is a perspective view of a trap assembly generally according to the principles of the present invention.

Turning to the Drawings, wherein like numbers denote like parts throughout the several views, FIG. 1 shows a preferred embodiment of a projectile trap assembly 40 in accordance with the principles of the present invention. The trap assembly 40 includes a support frame 42 having a bottom wall 44 (see FIG. 2) generally inclined from the horizontal ground, and two side walls 48,50. The support frame 42 also includes a substantially vertical rear wall 46 located adjacent to a top portion of the trap assembly 40. Those skilled in the art will recognize that the walls 44, 46, 48 and 50 can be made of a variety of known materials having sufficient rigidity to support the assembly 40. In one particular embodiment, the walls of the frame can be made of a sheet metal material such as steel.

Figure 2:
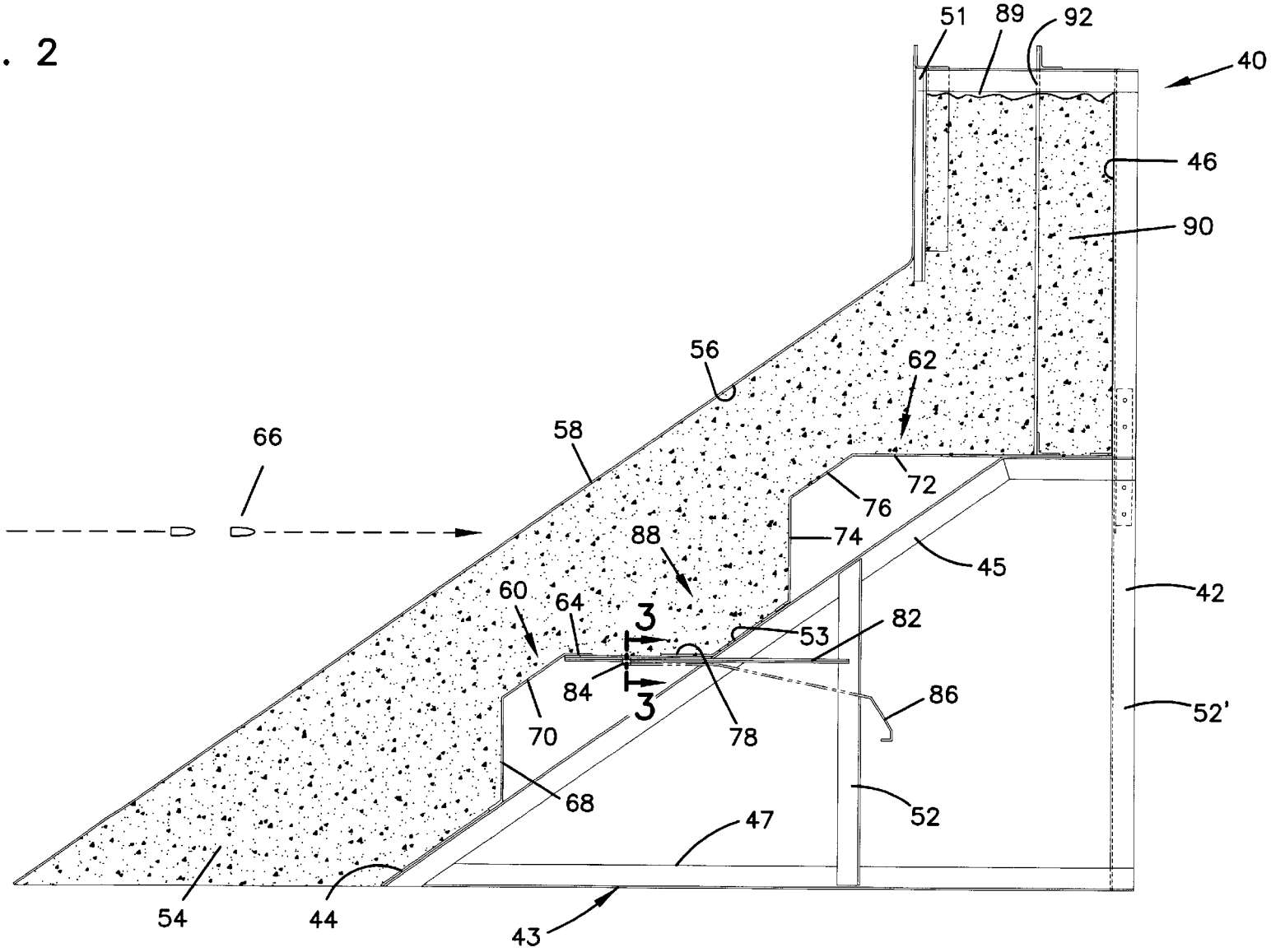
FIG. 2 is a cross-sectional view of the trap assembly.
Figure 4:
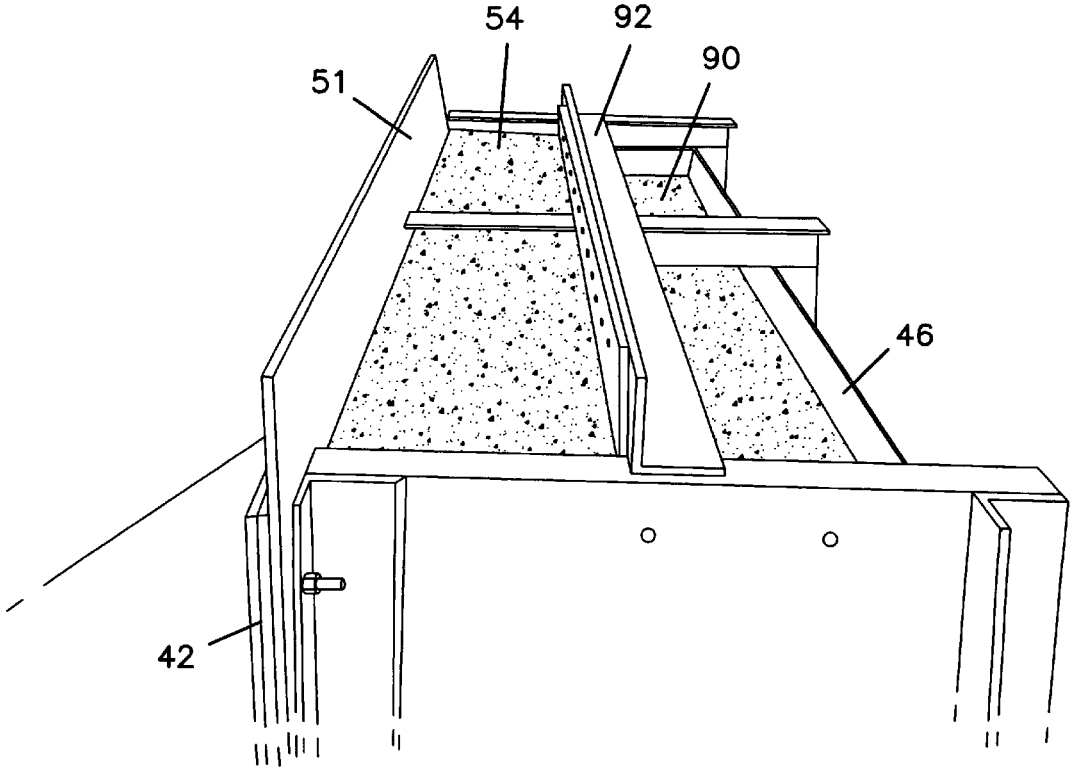
FIG. 4 is a partial, top perspective view of reserved and supplemental portions of particulate material in the trap assembly.

As shown in FIGS. 1, 2 and 4, the support frame 42 includes a plurality of generally triangular truss structures 43 arranged and configured for supporting the bottom wall 44, the side walls 48 and 50, and the rear wall 46. Each truss structure 43 includes an inclined beam 45 for supporting the bottom wall 44, and a base beam 47 that is supported by the ground. Each truss structure 43 also includes an intermediate post 52 positioned beneath the bottom wall 44, and a rear post 52 located at the back of the trap assembly 40. The rear posts 52' are adapted to support the rear wall 46 of the support frame 42.

In one embodiment of the present invention, the support trusses 43 can be located every 4 to 5 feet along the length and/or width of the assembly. It will also be appreciated to a person skilled in the art that the trusses can be eliminated as long as the frame 42 is self-supportive. In an alternative embodiment, the side walls 48,50 can be eliminated. One of the functions of the side walls is to help restrain flying granulate material once projectiles hit the material. Accordingly, the assembly without the side walls 48,50 can be installed at an installation site where there are walls which are able to restrain the flying materials.

Although the bottom wall has multiple portions having various inclinations, the general inclination of the bottom wall 44 from the horizontal ground generally coincides with the inclination of the inclined beams 45 of the trusses 43 and is preferably in the range of 30–40 degrees. It will be appreciated to a person skilled in the art that the general inclined angle can be smaller than 30 degrees or larger than 40 degrees without departing the scope and spirit of the present invention.

Supported by the bottom wall 44 is a particulate flowable granulate material 54. Preferably, the granulate material 54 flows down from the top of the trap assembly by gravity and covers the upper surface of the bottom wall 44 within the two side walls 48,50. Granulate material 54 preferably consists of a particulate rubber material having an exemplary particle size of about 5–7 mm and an exemplary angle of repose A of approximately 38 degrees from the horizontal ground. The general inclination of the bottom wall 44 can be the same as the angle of repose of the material 54. Also, the general inclination of the bottom wall 44 can be smaller than the angle of repose of the material 54. Alternatively, the general inclination of the bottom wall can be larger than the angle of repose of the material 54. Accordingly, depending on which target region is designed to receive a concentrated amount of projectiles, the inclined angle of the bottom wall 44 with respect to the angle of repose can be adjusted without departure of the principle of the invention. This adjustment can also be made by changing the granulate material 54 which has a different angle of repose. In one embodiment shown in FIG. 2, the upper surface of the granulate material 54 is inclined relative to a line of projectiles 66 which typically is substantially parallel to the ground. The material 54 has an angle of repose A, and the inclined bottom wall 44 has an general inclined angle of A as well.

To facilitate entrapment of the projectiles and to prevent splashing of the granulate particles, projectile trap assembly 40 may further include a self-healing member 58 covering the upper surface 56 of the particulate granulate material 54, as illustrated in phantom line in FIG. 1. Preferably, the self-healing member 58 lies on the top of or in front of the granulate particles. The self-healing member 58 allows the projectiles to penetrate therethrough, whereby the projectiles firing at the front of the assembly 40 are slowed down and captured by the granulate material 54. The self-healing member 58 can be made of rubber. However, it will be appreciated that other types of suitable materials can be used without departing the scope and spirit of the present invention. It will also be appreciated that the present invention is not limited to traps having covers.

Referring to FIG. 2, the bottom wall 44 includes base portions 53 that are connected and substantially parallel to the inclined beams 45 of the trusses 43. The bottom wall 44 includes at least one step that projects outward from the base portions 53 to define a pocket for receiving/supporting an increased depth of granular particles. Step(s) are used to extend the support surface, control the flow of the material when it flows down, and provide an area for a trap door, etc. Steps can also be arranged and configured to alter, at desired locations such as target regions, the depth of particulate material covering the bottom wall 44.

In one embodiment, the bottom wall 44 includes a first step 60 and a second step 62. It will be appreciated that additional steps can be used. The first step 60 is below the second step 62. The first step 60 has a first surface 64 adapted to be generally parallel to an exemplary line of the projectiles 66, a second surface 68 adapted to be generally perpendicularly aligned with respect to the first surface 64, and a third surface 70 extending between the first and the second surfaces 64,68. The second step 62 has a first surface 72 adapted to be generally parallel to the line of the projectiles, a second surface 74 adapted to be generally perpendicularly aligned with respect to the first surface 72, and a third surface 76 extending between the first and the second surfaces 72,74. The third surfaces 70,76 are inclined relative to the line of the projectiles, respectively. In one embodiment, the third surfaces are aligned at an angle of repose of the particulate material 54.

It will be appreciated that a person skilled in the art would recognize that the steps can be formed in any shapes consistent with the principles of the present invention. For example, the first, second, and third surfaces of steps 60,62 can be inclined with respect to the line of projectiles and/or curved surface and/or other shaped surface, respectively. Alternatively, the first surfaces of the steps 60,62 may decline relative to the line of travel of the projectiles. Furthermore, it will also be appreciated that a step may only have two surfaces or may have more than three surfaces.

Figure 3:
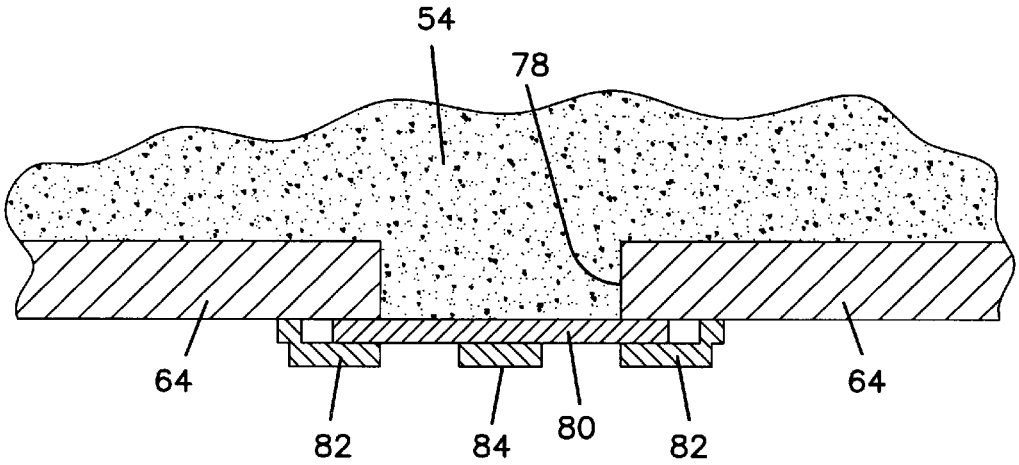
FIG. 3 is an enlarged cross-sectional view of a trap door on the trap assembly along line I—I of FIG. 2.

Referring back to FIG. 2, the first surface 64 of the first step 60 has an opening 78 which is closable by a door. In one embodiment as shown in FIG. 3, a door 80 slidable between brackets 82 opens and closes the opening 78 of the first surface 64. When the door is open, a volume of granulate material 54 disposed around the opening 78 flows out of the opening by gravity. A container, conveyor or similar receptor (not shown) may be included to receive the falling granulate material below the bottom wall 44. The brackets 82 are attached to the outer surface of the first surface 64. It will be appreciated that other types of door assemblies and attachment means can be used without departing the scope and the spirit of the present invention. Further in one embodiment, the door 80 has a handle 84 which helps open and close the door 80. The handle 80 can be attached to a tool, such as a pulling bar 86 shown in phantom line. It will be appreciated that other types of opening/closing means, such as an electronic, magnetic, or pneumatic opening/closing devices can be used in accordance with the principles of the invention. It will also be appreciated that the trap door and its corresponding opening can be disposed at any part of the bottom wall 44 and/or side walls 48,50 and/or other surfaces 70,68 of the first step 60 or any surface 72,74,76 of the second step 62. It will further be appreciated that multiple doors can be used to remove the captured projectiles and the material 54, and that the trap door(s) may be installed at any desired location of the assembly, e.g. any location on the bottom wall 44 and/or the side walls 48,50, etc.

As shown in FIG. 2, the first and second steps 60,62 are arranged to extend toward the upper surface 56 of the granulate material 54 such that the steps help control the flow of the materials when the door 80 is open so as to let the material disposed around the door 80 out of the opening 78 first. A primary volume of particulate material 54 includes a target region 88, circled by a phantom line as example, in which a majority of the projectiles are captured. In one embodiment, the target region 88 is generally defined between the first surface 64 of the first step 60, the second surface 74 of the second step 62, and the upper surface 56 of the granulate material. The trap door 80 is configured to allow a portion of the primary volume of particulate material 54, coinciding generally with the target region 88, to be removed from the trap assembly 40 through the support frame 42. Accordingly, the most targeted region of the trap assembly 40 can be replaced by fresh or less targeted granulate material. It will be appreciated that the target region can be any part of the material 54.

In one embodiment, when the door 80 is opened, the granulate material at the upper stream flows down by gravity along the bottom wall 44 to supply the target region 88. It will be appreciated that instead of by gravity, other means of supplying the target region can be used, such as by conveyor means, etc. Referring to FIG. 2, extra granulate material for supplying material to the target region 88 is stored in a reserve area 89 located at the top of the assembly 40 between a front wall 51 and an intermediate wall 92. The front and intermediate walls 51 and 92 are preferably made of a penetrable material such as rubber. However, the invention is not so limited. The removed granulated material from the target region 88 with the projectiles trapped therein can be recycled by separating the granular material from the projectiles and then re-filling the reserve area 89. Alternatively, fresh granulate material can be refilled and/or filled in the reserve area 89. It will be appreciated that the size and the height of the region can be varied without departing from the scope and spirit of the invention.

Referring to FIGS. 2 and 4, a separate supplemental volume of particulate material 90 is disposed in a supplemental chamber located behind the reserve area 89 of the primary volume of particulate material 54. The supplemental volume 90 in the chamber is arranged and configured for providing a backup for slowing down and receiving/capturing the projectiles when the reserved granulate material 54 flows toward the target region 88. The supplemental volume 90 is separated from the primary volume 54 by the intermediate wall 92 which is attached to the support frame 42. It will be appreciated that separation between the two volume of materials can be made by any other suitable means, and that other types of backup means for slowing down and receiving/capturing the projectiles, especially when the primary volume in the reserved area is low due to supplying of the material to downstream, can be used without departing from the principles of the invention.

It will be appreciated that a single unit or multiple units of the primary and supplemental volumes of materials can be used. It will also be appreciated that multiple trap doors, such as the one like the door 80, and their corresponding openings can be made on the bottom wall 44 or the side walls 48,50 of the supporting frame 42.

As will be appreciated however, the type, size, and characteristics of the granulate material 54,90 are provided by way of example, not of limitation. Other particulate materials may be used. Moreover, these material and the exemplary rubber material may further be interspersed with an anti-adhesion material and/or fire-retardent material for increased safety. As one skilled in the art appreciates that various modifications may be made to the above described embodiment without departing from the spirit and scope of the invention, the invention thus resides in the claims hereafter appended.

What is claimed is:

1. A projectile trap assembly for capturing projectiles, the trap assembly comprising:

a support frame including a first support surface and a second support surface, the first and second surfaces being inclined relative to horizontal, and the first support surface being elevated relative to the second support surface;

a volume of particulate material disposed on the support frame for slowing down and capturing the projectiles;

the support frame defining a recessed pocket region positioned between the first and second support surfaces, wherein the volume of particulate material has a coverage thickness that is deeper at the recessed pocket region then at either of the first and second support surfaces.

2. The trap assembly of claim 1, wherein the support frame includes a door positioned adjacent to the pocket region.

3. The assembly of claim 2, wherein the door is adapted to allow particulate material from the pocket region to be removed from the trap assembly through the support frame.

4. The trap assembly of claim 3, wherein when the door is in a closed position, the door supports the particulate material within the pocket region.

5. A projectile trap assembly for capturing projectiles, the trap assembly comprising:

a support frame generally inclined relative to horizontal;

a volume of particulate material supported on the support frame for slowing down and capturing the projectiles, the particulate material being supported by the support frame at an angle inclined relative to horizontal; and the support frame including a door that can be opened to allow at least a portion of the particulate material to be removed from the trap assembly through the support frame.

* * * * *